US005485134A

United States Patent [19]

Seymour et al.

[11] Patent Number: 5,485,134

[45] Date of Patent: Jan. 16, 1996

[54] AUXILIARY SWITCH ACCESSORY MODULE UNIT FOR HIGH AMPERE-RATED CIRCUIT BREAKER

[75] Inventors: Raymond K. Seymour, Plainville; Elaine B. Bogue, Stonington, both of Conn.

[73] Assignee: General Electric Company, New York, N.Y.

[21] Appl. No.: 251,154

[22] Filed: May 31, 1994

[51] Int. Cl.[6] ..... H01H 67/02

[52] U.S. Cl. ..... 335/132; 335/202

[58] Field of Search ..... 335/131, 132, 335/202

[56] References Cited

U.S. PATENT DOCUMENTS 4,408,174 10/1983 Seymour et al. .

5,012,215 4/1991 Floc'h ..... 335/132

5,252,937 10/1993 Bernier et al. ..... 335/202

*Primary Examiner*—Lincoln Donovan

*Attorney, Agent, or Firm*—Richard A. Menelly

[57] ABSTRACT

A high ampere-rated circuit breaker which meets the electrical code requirements of the world market. The circuit breaker electronic trip unit is contained within a trip unit recess in the circuit breaker cover. Accessory units are contained within an adjoining accessory compartment recess. A separate auxiliary switch accessory module is positioned within the trip unit recess to interface with the circuit breaker operating mechanism and provide external indication as to a trip occurrence.

23 Claims, 4 Drawing Sheets

AUXILIARY SWITCH ACCESSORY MODULE UNIT FOR HIGH AMPERE-RATED CIRCUIT BREAKER

BACKGROUND OF THE INVENTION

U.S. Pat. No. 4,408,174 entitled "Accessory Mounting Module for J and K Frame Breakers" discloses a mounting module for receiving an auxiliary switch accessory to indicate the occurrence of an overcurrent circuit interruption within a protected electric distribution circuit. To insert the accessory module, the circuit breaker case and cover must first be removed to expose the circuit breaker operating mechanism which necessitates factory installation and incurs late shipment of product.

U.S. patent application Ser. No. 08/247,900 filed May 25, 1994 entitled "Accessory Compartment for High Ampere-rated Circuit Breaker" describes an integrated circuit breaker having several accessory functions along with automatic overcurrent protection, which allows selection between the various accessory functions in different combinations. Separate switches arranged on the circuit interrupter trip unit allow factory as well as field selection of the accessory function combinations. The selected accessory units are inserted in the circuit interrupter cover adjacent to the trip unit.

The purpose of the instant invention is to describe an auxiliary switch module that positionally mounts a plurality of auxiliary switches in interface relation with the circuit breaker operating mechanism.

SUMMARY OF THE INVENTION

The circuit breaker electronic trip unit controlling a high ampere-rated circuit breaker is contained within a recess in the circuit breaker cover. An auxiliary switch accessory module unit is mounted on the same support platform as the trip unit and contains a plurality of micro-switches or provide remote indication as to the occurrence to an overcurrent circuit interruption or indication of the status of the main circuit breaker contacts. A roller pivotally arranged within the module simultaneously actuates the corresponding buttons on each of the micro-switches by interaction with a lever on the circuit breaker operating mechanism.

DESCRIPTION OF THE PREFERRED EMBODIMENT

Figure 1:
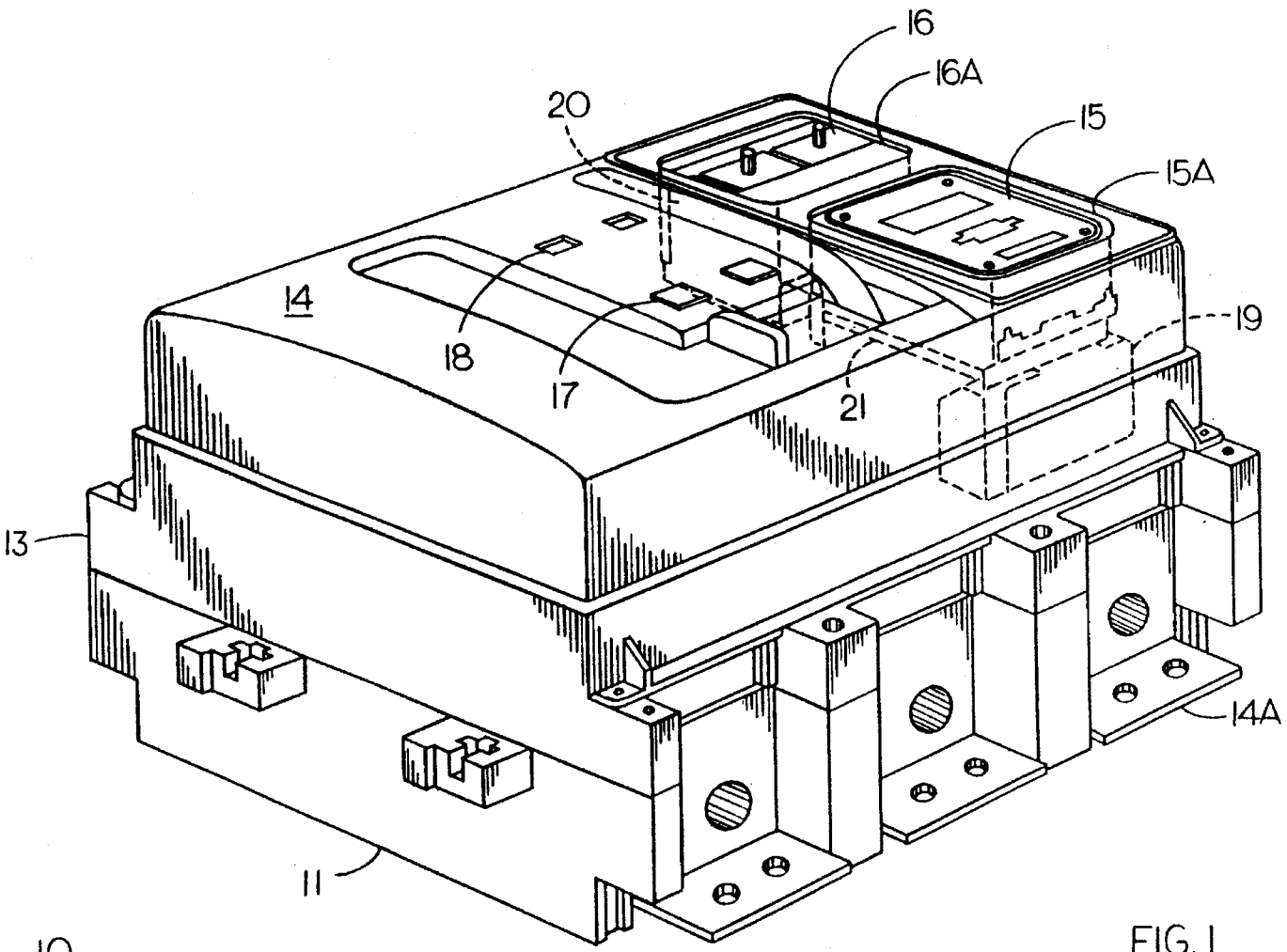
FIG. 1 is a top perspective view of a high ampere-rated circuit breaker containing the auxiliary switch accessory module according to the invention.

The high ampere-rated circuit breaker 10 shown in FIG. 1 is capable of transferring several thousand amperes quiescent circuit current at several hundred volts potential without overheating. The circuit breaker consists of an electrically insulated base 11 to which an intermediate cover

13 of similar insulative material is attached prior to attaching the top cover 14, also consisting of an electrically-insulative material. Electrical connection with the interior current-carrying components is made by load terminal straps 14A extending from one side of the base and line terminal straps (not shown) extending from the opposite side thereof. The interior components are controlled by an electronic trip unit 15 contained within a recess 15A in the top surface of the top cover 14. The trip unit is similar to that described within the U.S. Pat. No. 4,658,323 entitled "RMS Calculation Circuit for Digital Circuit Interrupters" and interacts with accessories such as the bell alarm and lock-out accessory 16 contained within the accessory recess 16A as described within U.S. patent application Ser. No. 08/248,910 filed May 25, 1994 entitled "Bell Alarm and Lock-out Accessory for High Current Circuit Breakers". The buttons 17 allow the circuit breaker operating mechanism to be reset after a circuit interruption has occurred, and indicators 18 provide visual indication as to the ON and OFF conditions of the circuit breaker contacts. As described within the aforementioned U.S. patent application Ser. No. 08/248,900 entitled "Accessory Compartment for High Ampere-rated Circuit Breaker", a common support frame 21 supports both the accessory module 20 as well as the trip unit 15. The same support frame further serves to support the auxiliary switch module unit 19 which functions to provide remote indication of the occurrence of an overcurrent circuit interruption.

Figure 2:
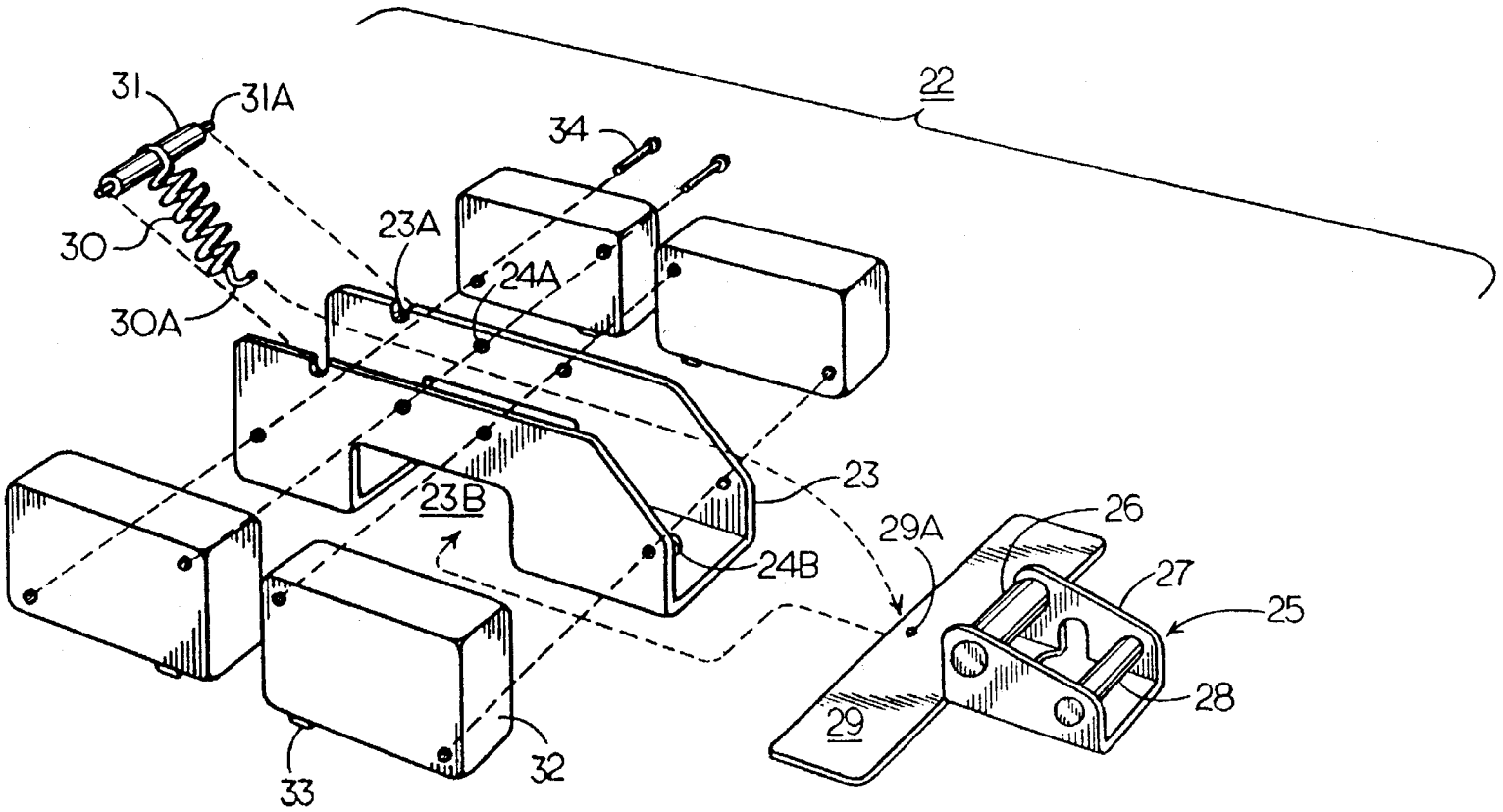
FIG. 2 is a top perspective view of the components within the accessory module of FIG. 1 prior to assembly.

The auxiliary switch module components 22 are shown in FIG. 2 prior to assembly. The subframe 23 is formed from a unitary metal plate and defines a U-shaped configuration with side and bottom thru-holes designated 24A and 24B respectively. An extension spring 30 is supported at one end by a pin 31 having ends 31A received within slots 23A formed within the top part of the subframe 23. The hooked end 30A of the extension spring 30 is received within the thru-hole 29A in the planar end 29 of the lever 25. The end 29 sits within the U-shaped slot 23B formed in the bottom of the subframe 23 and is biased against the bottom by means of the spring 30. As many as twelve microswitches 32 can be attached to the subframe 23 by means of screws or rivets 34 and corresponding thru-holes 24A. With the microswitches attached to the subframe, the buttons 33 extending from the bottom thereof simultaneously contact and become depressed by the end 29 of the lever 25. The roller 26 extending between the U-shaped support 27 on the lever 25 positionally interacts with a lever 48 (FIG. 4) extending from the circuit breaker operating mechanism within the circuit breaker 10 of FIG. 1. The pin 28 extending parallel to the roller 26 provides pivotal support to the lever 25.

Figure 3:
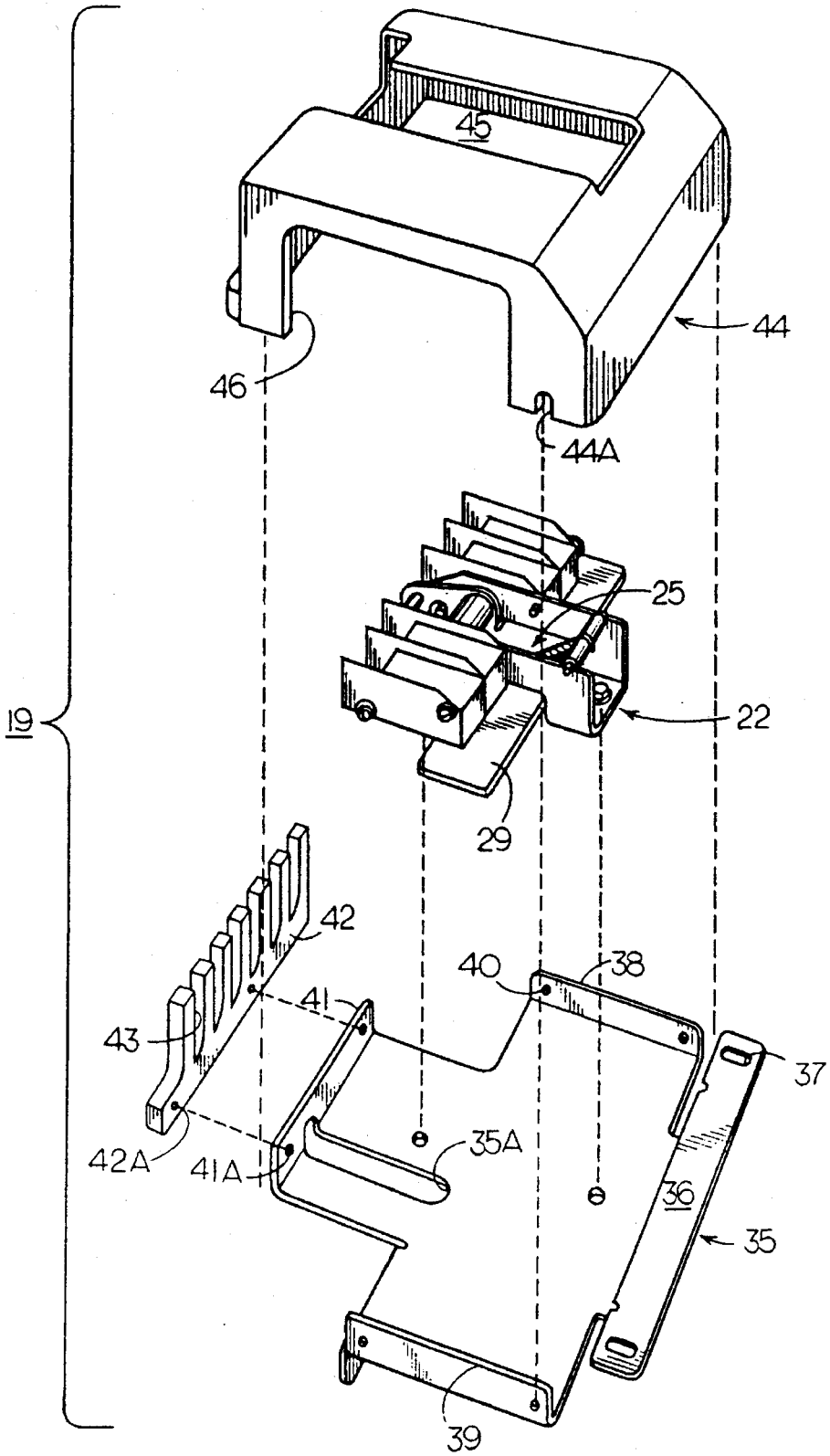
FIGS. 3 is a top perspective view of the accessory module components in isometric projection between the module support frame and the module cover.

The assembled auxiliary switch module components 22 are shown in FIG. 3 prior to attachment of the cover 44 and support frame 35 to form the complete auxiliary switch 19. The T-shaped access slot 45 in the top and front of the cover 44 provides access to the aforementioned circuit breaker lever and the rectangular slot 46 in the sidewall of the cover provides access to the wire conductors (not shown) which connect the microswitches with remote audio and visible indicators. The strain relief wireway 42 is attached to the endwall 41 of the support frame 35 by means of thru-holes 41A, 42A which position the elongated slots 43 within the rectangular opening 46 in the cover 44. The slotted opening 35A in the support frame 35 underlies a part of the end 29 of the lever 25 for access thereto from the bottom of the support frame. When the cover is attached to the support frame by means of thru-holes 44A in the sidewalls of the cover and the thru-holes 40 in the corresponding sidewalls 38, 39 in the support frame, the angulated platform 36 extends outboard of and alongside of the cover to position the mounting slots 37 in the platform 36 against the support 21 beneath the trip unit 15 as shown in FIGS. 1 and 4.

Figure 4:
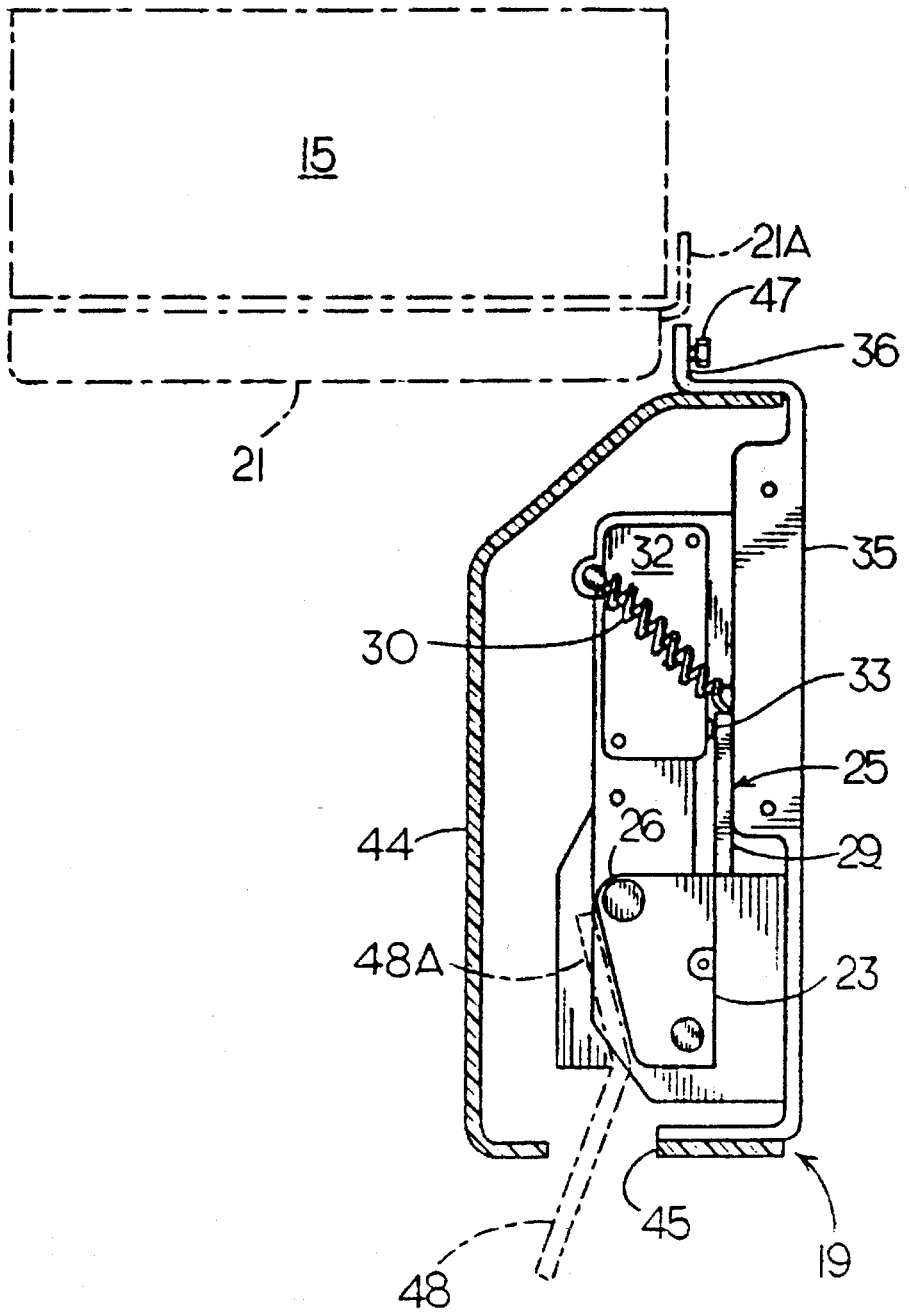
FIG. 4 is a side view in partial section of the auxiliary switch accessory module of the invention attached to the trip unit mounting platform of FIG. 1.

Referring to FIG. 4, the attachment of the support frame 35 of the auxiliary switch 19 to the edge 21A of the support 21 by means of screws 47, precisely positions the bottom of the T-shaped slot 45 through the cover 44 over the circuit breaker lever 48 and the top 48A of the lever against the roller 26. The buttons 33 on the bottom of the microswitches 32 are positioned against the end 29 the lever 25 on the subframe 23.

In operation, the top 48A of the lever 48 moves in and out of contact with the roller 36 to drive the end 29 of the lever 25 away from the buttons 33 against the return bias of the spring 30. The microswitches can be normally-open or closed depending upon the users' specifications.

We claim:

1. An industrial-rated circuit breaker for high level overcurrent protection comprising:

an insulative circuit breaker cover 14 arranged on an insulative base 12;

a recess 15A in said circuit breaker cover;

a support 21 within said recess; an electronic trip unit 15 on said support and arranged for interrupting circuit current upon occurrence of an overcurrent condition;

an auxiliary switch 19 attached to said support and arranged for providing remote indication of said overcurrent condition, said auxiliary switch comprising a microswitch 32 attached to a subframe 23, said subframe including a lever 25 mounted on said subframe and arranged for interacting with a circuit operating mechanism lever 48 extending upwards within said circuit breaker cover.

2. The industrial-rated circuit breaker of claim 1 wherein said lever includes a planar end 29 arranged within a slot 23B formed in a bottom of said subframe.

3. The industrial-rated circuit breaker of claim 2 including a bias spring connecting between said subframe and said end of said lever to bias said end against said bottom of said subframe.

4. The industrial-rated circuit breaker of claim 3 including a roller 26 on said lever, said roller being contacted by said circuit breaker lever to drive said end of said lever against said bias of said bias spring.

5. The industrial-rated circuit breaker of claim 4 wherein said microswitch includes a button 33 extending from a bottom thereof, said button contacting said end of said lever for activating said microswitch between ON and OFF conditions.

6. The industrial-rated circuit breaker of claim 4 wherein said bias spring is supported on said subframe by means of a support pin 31 extending between a pair of slots 23A formed on a top part of said subframe.

7. The industrial-rated circuit breaker of claim 6 wherein said roller extends between a U-shaped support 27 formed on said lever.

8.The industrial-rated circuit breaker of claim 7 wherein said subframe and said lever are arranged on a support frame 35.

9. The industrial-rated circuit breaker of claim 8 including an auxiliary switch cover 44 attached to said support frame.

10. The industrial-rated circuit breaker of claim 9 including an angled platform 36 extending upwards from said support frame external to said auxiliary switch cover.

11. The industrial-rated circuit breaker of claim 9 wherein said auxiliary switch cover defines a T-shaped slot providing access between said circuit breaker operating mechanism lever and said roller.

12. The industrial-rated circuit breaker of claim 9 including a strain relief wireway 42 attached to said support frame for providing strain relief to wires connecting with said microswitch.

13. The industrial-rated circuit breaker of claim 9 including a rectangular slot 46 within said auxiliary switch cover providing access for said wires connecting with said microswitch.

14. An auxiliary switch accessory unit for industrial-rated circuit breakers comprising:

a microswitch 32 attached to a subframe 23; a lever 25 mounted on said subframe and arranged for interacting with a circuit operating mechanism lever 48 for providing remote indication of overcurrent circuit interruption, said lever including a planar lanar end 29 arranged within a slot 23B formed in a bottom of said subframe;

a bias spring connecting between said subframe and said end of said lever to bias said end against said bottom of said subframe; and a roller on said lever, said roller being contacted by said circuit breaker lever to drive said end of said lever against said bias of said bias spring.

15. The auxiliary switch accessory unit of claim 14 wherein said microswitch includes a button 33 extending from a bottom thereof, said button contacting said end of said lever for activating said microswitch between ON and OFF conditions.

16. The auxiliary switch accessory unit of claim 14 wherein said bias spring is supported on said subframe by means of a support pin 31 extending between a pair of slots 23A formed on a top part of said subframe.

17. The auxiliary switch accessory unit of claim 14 wherein said roller extends between a U-shaped support 27 formed on said lever.

18. The auxiliary switch accessory unit of claim 14 wherein said subframe and said lever are arranged on a support frame 35.

19. The auxiliary switch accessory unit of claim 14 including an auxiliary switch cover 44 attached to said support frame.

20. The auxiliary switch accessory unit of claim 14 including an angled platform 36 extending upwards from said support frame external to said lever includes a planar end 29 arranged within a slot 23B formed in a bottom of said subframe.

21. The auxiliary switch accessory unit of claim 14 wherein said auxiliary switch cover defines a T-shaped slot providing access between said circuit breaker operating mechanism lever and said roller.

22. The auxiliary switch accessory unit of claim 14 including a strain relief wireway 42 attached to said support frame for providing strain relief to wires connecting with said microswitch.

23. The auxiliary switch accessory unit of claim 14 including a rectangular slot 46 within said auxiliary switch cover providing access for said wires connecting with said microswitch.

* * * * *